US007413684B2

(12) United States Patent
Fishburn et al.

(10) Patent No.: US 7,413,684 B2
(45) Date of Patent: Aug. 19, 2008

(54) POLY(ARYLENE ETHER)/POLYAMIDE COMPOSITION

(75) Inventors: James Ross Fishburn, Slingerlands, NY (US); Robert Hossan, Delmar, NY (US); Sai Pei Ting, Slingerlands, NY (US)

(73) Assignee: Sabic Innovative Plastics IP B.V. (NL)

( * ) Notice: Subject to any disclaimer, the term of this patent is extended or adjusted under 35 U.S.C. 154(b) by 462 days.

(21) Appl. No.: 11/107,684

(22) Filed: Apr. 15, 2005

(65) Prior Publication Data

US 2006/0231809 A1 Oct. 19, 2006

(51) Int. Cl.
*H01B 1/24* (2006.01)

(52) U.S. Cl. ..... 252/500; 252/511; 524/62; 524/424; 524/495

(58) Field of Classification Search ..... 252/500, 252/511; 525/62, 424, 495
See application file for complete search history.

(56) References Cited

U.S. PATENT DOCUMENTS

| | | | |
|---|---|---|---|
| 2,071,250 | A | 2/1937 | Carothers |
| 2,071,251 | A | 2/1937 | Carothers |
| 2,130,948 | A | 2/1938 | Carothers |
| 2,130,523 | A | 9/1938 | Carothers |
| 2,241,322 | A | 5/1941 | Hanford |
| 2,312,966 | A | 3/1943 | Hanford |
| 2,512,606 | A | 6/1950 | Bolton et al. |
| 3,379,792 | A | 4/1968 | Finholt |
| 4,772,664 | A | 9/1988 | Ueda et al. |
| 4,857,575 | A | 8/1989 | van der Meer et al. |
| 4,873,276 | A | 10/1989 | Fujii et al. |
| 4,873,286 | A | 10/1989 | Gallucci et al. |
| 4,929,388 | A | 5/1990 | Wessling |
| 4,970,272 | A | 11/1990 | Gallucci |
| 5,000,897 | A | 3/1991 | Chambers |
| 5,109,052 | A | 4/1992 | Kasai et al. |
| 5,132,365 | A | 7/1992 | Gallucci |
| 5,310,821 | A | 5/1994 | Kodaira et al. |
| 5,397,838 | A | 3/1995 | Ohtomo et al. |
| 5,484,838 | A | 1/1996 | Helms et al. |
| 5,534,600 | A | 7/1996 | Bailly et al. |
| RE35,509 | E | 5/1997 | Fujii et al. |
| 5,719,233 | A | 2/1998 | Gallucci et al. |
| 5,723,539 | A | 3/1998 | Gallucci et al. |
| 5,760,125 | A | 6/1998 | Ohtomo et al. |
| 5,760,132 | A | 6/1998 | McGaughan et al. |
| 5,843,340 | A | 12/1998 | Siivi et al. |
| 5,977,240 | A | 11/1999 | Marie Lohmeijer et al. |
| 6,352,654 | B1 * | 3/2002 | Silvi et al. ..... 252/511 |
| 6,593,411 | B2 | 7/2003 | Koevoets et al. |
| 2002/0149006 | A1 | 10/2002 | Hossan et al. |
| 2003/0092824 | A1 | 5/2003 | Bastiaens et al. |
| 2003/0116757 | A1 | 6/2003 | Miyoshi et al. |
| 2003/0166762 | A1 | 9/2003 | Koevoets et al. |

* cited by examiner

*Primary Examiner*—Ana L Woodward
(74) *Attorney, Agent, or Firm*—Cantor Colburn LLP

(57) ABSTRACT

A conductive composition comprises a poly(arylene ether), a polyamide, a conductive additive, and an impact modifier, wherein the composition demonstrates less than or equal to 0.0150 grams of composition buildup on the die face per minute of running time per meter of die opening perimeter after extruding the composition at a steady state for five minutes.

25 Claims, 2 Drawing Sheets

POLY(ARYLENE ETHER)/POLYAMIDE COMPOSITION

BACKGROUND OF INVENTION

Poly(arylene ether) resins have been blended with polyamide resins to provide compositions having a wide variety of beneficial properties such as heat resistance, chemical resistance, impact strength, hydrolytic stability and dimensional stability.

These beneficial properties are desirable in a wide variety of applications and the shapes and sizes of the parts required for these applications vary widely. As a result there are a variety of forming or molding methods employed such as injection molding, compression molding and extrusion. Each forming method requires a different set of physical characteristics for the polymer being formed. For example, materials that are preferable for use in high shear forming processes such as injection molding are usually designed to have relatively low melt viscosities (high melt volume rate (MVR)) at shear rates greater than 1000 $s^{-1}$ in order to allow adequate mold cavity filling without excessive pressures. Alternatively, materials that are more preferred for use in low shear forming processes such as profile extrusion are usually designed to have relatively high melt viscosities (low MVR) at shear rates less than 1000 $s^{-1}$. This is because profile extrusion requires that the material be forced through a shaped die (a profile) and maintain the extruded shape until cooled. The extruded shape can be further manipulated while the polymer blend is still warm through the use of shaping tools and the shaped profile must retain its shape after manipulation. A material with high melt viscosity is better able to maintain the shape until cooling is completed. A blend which is suitable for high shear processes such as injection molding may not be suitable for low shear processes such as blow molding, sheet extrusion and profile extrusion.

In some applications it is desirable that the extruded shape be electrostatically paintable which requires use of a conductive material. Unfortunately the inclusion of electrically conductive additives in high melt viscosity blends can be problematic, particularly in a multi phase polymer blends such as a poly(arylene ether)/polyamide blend.

BRIEF DESCRIPTION OF THE INVENTION

The foregoing needs are addressed by a composition comprising a poly(arylene ether), a polyamide, an electrically conductive additive, and an impact modifier, wherein the composition has a melt volume rate less than or equal to 15 cubic centimeters per 10 minutes (cc/10 minutes) as determined by ISO 1133 performed at 300° C. with a load of 5 kilograms when the composition moisture content, at the time of testing, is less than or equal to 0.05 weight percent (wt %), based on the total weight of the composition, and further wherein the composition demonstrates less than or equal to 0.0150 grams of composition buildup on the die face per minute of running time per meter of die opening perimeter (g/(meters*min)) after extruding the composition at a steady state for five minutes at 260° C. and 100 rotations per minute (rpm) on a 19 millimeter diameter single screw extruder through a rectangular slit die having a width of 102 millimeters (mm), an opening height of 2 mm and a depth of 29 mm with a die set temperature of 280° C. and further wherein no cooling means is applied to the extruded composition until the composition is greater than or equal to 100 millimeters from the die face. The weight in grams is the weight of build up on the die face. The time in minutes is the amount of time run to accumulate the die-lip build-up. The distance in meters is the perimeter of the die opening through which the material is being formed. The material flow rate through the die is 4.5 to 5.5 kilograms per hour (kg/hr) as determined by weighing the ribbon that has gone through the downstream uptake reels over a known amount of time. The uptake reels are set to pull the ribbon at a rate of 1.45 meters/minute to 1.50 meters/min.

DETAILED DESCRIPTION

Figure 2:
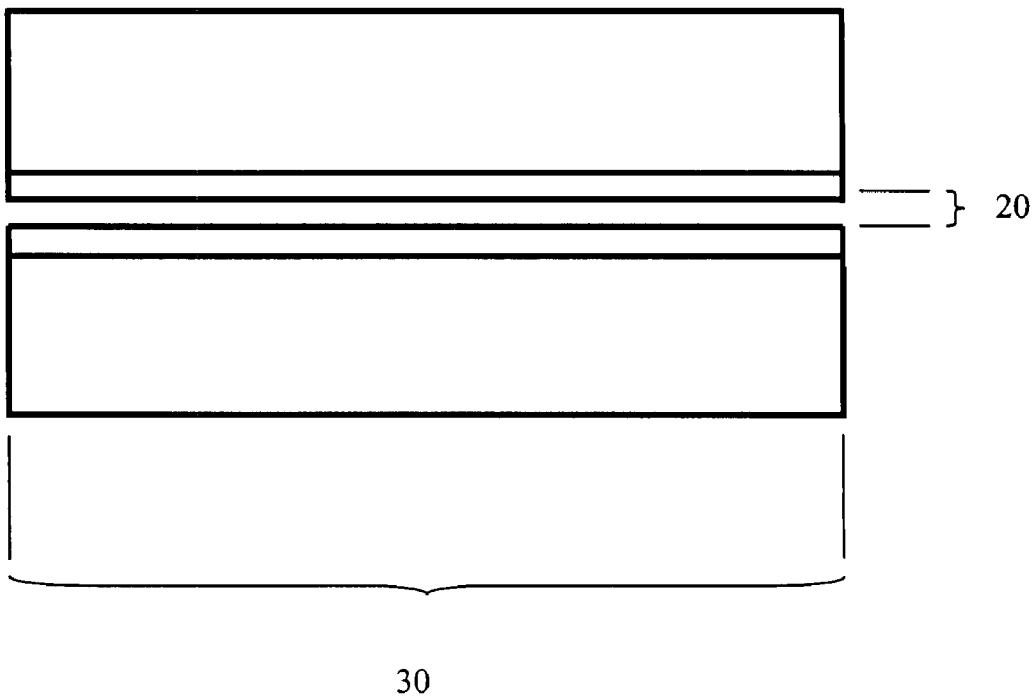
FIG. 2 is a front view of a rectangular slit die.

As mentioned above low shear forming processes require materials with a melt strength sufficiently high and a melt flow rate sufficiently low to maintain the desired shape after leaving the extrusion die or mold. Additionally it is highly desirable for the formed material to leave little or no material build up on the die lip. Die lip build up can result in surface defects in the formed material and wastes material. When die lip build up occurs, the die must be cleaned, decreasing the efficiency of the forming process.

In electrostatic painting methods the conductive formed part can be subjected to at least one heating step, making heat resistance a desirable feature, particularly the ability to substantially maintain the original shape during and after the heating step.

A composition useful in low shear forming processes comprises a poly(arylene ether), a polyamide, an impact modifier, and an electrically conductive additive, wherein the composition has a melt volume rate less than or equal to 15 cc/10 minutes as determined by ISO 1133 performed at 300° C. with a load of 5 kilograms. The composition has a moisture content, at the time of ISO 1133 testing, less than or equal to 0.05 weight percent (wt %), based on the total weight of the composition. Moisture content can be determined by weighing 50 grams of the composition held at a temperature of 160° C. and recording the loss in weight every 1.5 minutes. The endpoint is determined when the slope of the graph recording the change in weight is 0.005.

The composition demonstrates less than or equal to 0.0150 g/(meter*minute) of composition buildup on the die face after extruding the composition at a steady state for five minutes at 260° C. and 100 rotations per minute (rpm) on a 19 millimeter diameter single screw extruder through a rectangular slit die having a width of 102 mm, an opening height of 2 mm, and a depth of 29 mm with a die set temperature of 280° C. and a material flow rate through the die of 4.5 and 5.5 kg/hr. As understood by one of ordinary skill in the art, when a material is introduced into an extruder it takes a period of time for a steady state to be achieved. The length of this period of time varies depending on the size of the extruder and speed at which it is being run. For a laboratory scale bench top extruder having a 19 millimeter diameter single screw the amount of time is typically 15 minutes.

In one embodiment the composition showed less than or equal to 0.0118 grams/(meter*minute), or, more specifically, less than or equal to 0.0108 grams/(meter*minute) of composition build up on the die face after extruding the composition at a steady state for greater than or equal to five minutes at 260° C. and 100 rotations per minute (rpm) on a 19 millimeter diameter single screw extruder through a rectangular slit die a width of 102 mm, an opening height of 2 mm, and a depth of 29 mm with a die set temperature of 280° C. and a material flow rate through the die of 4.5 and 5.5 kg/hr.

The presence of little or no die lip build up may be related to the volatiles content of the conductive composition. Volatiles are herein defined as compounds that have a vaporization temperature less than or equal to the extrusion temperature of the composition under extrusion conditions. As readily appreciated by one of ordinary skill in the art, temperature and pressure both affect the temperature at which a liquid or solid becomes a vapor. Exemplary extrusion conditions are 230 to 315° C. and 7 kilograms/centimeter$^2$ (kg/cm$^2$) to 355 kg/cm$^2$. Volatiles can include compounds such as caprolactam, styrene, and residual solvent.

In one embodiment, the volatiles content of the pelletized conductive composition is less than or equal to about 0.18%, or more specifically, less than or equal to 0.17%. As readily understood by one of ordinary skill in the art and described in greater detail below, the composition is formed by melt blending (melt compounding) the components and once melt blending is completed, the composition is formed into pellets. These pellets are referred to herein as the pelletized conductive composition.

In another embodiment, the volatiles content of an extruded conductive composition is less than or equal to about 0.28%, or, more specifically, less than or equal to 0.27%. An extruded conductive composition is defined as a pelletized composition that has been subjected to a low pressure/low shear forming process.

Volatiles content may be determined by heating a sample to 275° C. for 5 minutes and sweeping the off-gases to a cryogenic trap that serves as an injection port to a gas chromatograph connected to a quadrapole mass spectrometer (MS). The off-gases are ionized with 70 eV electrons in the MS source (called electron-ionization or EI-MS) and the total ion current for each compound is detected using an electron multiplier. The total ion current for all off-gases detected is then converted to % total volatiles using a calibration curve.

The melt volume rate of the composition is compatible with low shear processes. In one embodiment the composition has a melt volume rate less than or equal to 15 cc/10 min, or, more specifically, less than or equal to 13 cc/10 min, or, even more specifically, less than or equal to 11 cc/10 min, as determined by Melt Volume Rate test ISO 1133 performed at 300° C. with a load of 5 kilograms (kg). The composition has a melt volume rate greater than or equal to 3 cc/10 minutes. At the time of testing the composition has less than or equal to 0.05 weight percent moisture content, based on the total weight of the composition. When a composition comprising a poly(arylene ether), a polyamide, an electrically conductive additive, and an impact modifier has a melt volume rate greater than 15 cc/10 minutes at 300° C., the melt strength of the composition is reduced such that the material is not as easily formed into the desired final shape. This could result in material instability from the extruder die to the shaping equipment, or in reduced run rates of the equipment due to material tearing after exiting from the die.

The composition can have a Vicat B120 greater than or equal to 170° C., or, more specifically, greater than or equal to 180° C., or, even more specifically, greater than or equal to 190° C. The composition can have a Vicat B120 value less than or equal to 280° C. Vicat B120 is determined using ISO 306 standards. A Vicat B120 greater than or equal to 170° C. ensures that the composition has adequate heat performance for electrostatic coating.

Specific volume resistivity (SVR) is a measure of the leakage current directly through a material. It is defined as the electrical resistance through a one-centimeter cube of material and is expressed in ohm-cm. The lower the specific volume resistivity of a material, the more conductive the material is. In one embodiment the composition has a specific volume resistivity less than or equal to $10^6$ ohm-cm, or, more specifically, less than or equal to $10^5$, or, even more specifically, less than or equal to $10^4$. Specific volume resistivity can be determined as described in the Examples.

The terms "a" and "an" herein do not denote a limitation of quantity, but rather denote the presence of at least one of the referenced item. All ranges disclosed herein are inclusive and combinable (e.g., ranges of "up to 25 wt %, or, more specifically, 5 wt % to 20 wt %," is inclusive of the endpoints and all intermediate values of the ranges of "5 wt % to 25 wt %," etc.).

As used herein, a "poly(arylene ether)" comprises a plurality of structural units of the formula (I):

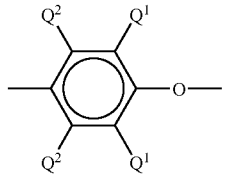

(I)

wherein for each structural unit, each $Q^1$ and each $Q^2$ is independently hydrogen, halogen, primary or secondary lower alkyl (e.g., an alkyl containing 1 to 7 carbon atoms), phenyl, haloalkyl, aminoalkyl, alkenylalkyl, alkynylalkyl, aryl, hydrocarbonoxy, or halohydrocarbonoxy wherein at least two carbon atoms separate the halogen and oxygen atoms. In some embodiments, each $Q^1$ is independently alkyl or phenyl, for example, $C_{1-4}$ alkyl, and each $Q^2$ is independently hydrogen or methyl. The poly(arylene ether) can comprise molecules having aminoalkyl-containing end group(s), typically located in a position ortho to the hydroxy group. Also frequently present are tetramethyl diphenylquinone (TMDQ) end groups, typically obtained from reaction mixtures in which tetramethyl diphenylquinone by-product is present.

The poly(arylene ether) can be in the form of a homopolymer; a copolymer; a graft copolymer; an ionomer; a block copolymer, for example comprising arylene ether units and blocks derived from alkenyl aromatic compounds; as well as combinations comprising at least one of the foregoing. Poly (arylene ether) includes polyphenylene ether containing 2,6-dimethyl-1,4-phenylene ether units optionally in combination with 2,3,6-trimethyl-1,4-phenylene ether units.

The poly(arylene ether) can be prepared by the oxidative coupling of monohydroxyaromatic compound(s) such as 2,6-xylenol and/or 2,3,6-trimethylphenol. Catalyst systems are generally employed for such coupling; they can contain heavy metal compound(s) such as a copper, manganese or cobalt compound, usually in combination with various other materials such as a secondary amine, tertiary amine, halide or combination of two or more of the foregoing.

The poly(arylene ether) can have a number average molecular weight, prior to melt mixing to make the composition, of 3,000 to 40,000 grams per mole (g/mol) and/or a weight average molecular weight, prior to melt mixing to make the composition, of about 5,000 to about 80,000 g/mol, as determined by gel permeation chromatography using monodisperse polystyrene standards, a styrene divinyl benzene gel at 40° C. and samples having a concentration of 1 milligram per milliliter of chloroform. The poly(arylene ether) can have an intrinsic viscosity, prior to melt mixing to make the composition, of 0.10 to 0.60 deciliters per gram (dl/g), or, more specifically, 0.29 to 0.48 dl/g, as measured in chloroform at 25° C. It is possible to utilize a combination of high intrinsic viscosity poly(arylene ether) and a low intrinsic viscosity poly(arylene ether). Determining an exact ratio, when two intrinsic viscosities are used, will depend somewhat on the exact intrinsic viscosities of the poly(arylene ether) used and the ultimate physical properties that are desired.

In one embodiment the poly(arylene ether) has a glass transition temperature (Tg) as determined by differential scanning calorimetry (DSC at 20° C./minute ramp), of 160° C. to 250° C. Within this range the Tg can be greater than or equal to 180° C., or, more specifically, greater than or equal to 200° C. Also within this range the Tg can be less than or equal to 240° C., or, more specifically, less than or equal to 230° C.

The composition comprises poly(arylene ether) in an amount of 15 to 65 weight percent. Within this range, the poly(arylene ether) can be present in an amount greater than or equal to 30 weight percent, or, more specifically, in an amount greater than or equal to 35 weight percent, or, even more specifically, in an amount greater than or equal to 40 weight percent. Also within this range the poly(arylene ether) can be present in an amount less than or equal to 60 weight percent, or, more specifically, less than or equal to 55 weight percent, or, even more specifically, less than or equal to 50 weight percent. Weight percent is based on the total weight of the thermoplastic composition.

Polyamide resins, also known as nylons, are characterized by the presence of an amide group (—C(O)NH—), and are described in U.S. Pat. No. 4,970,272. Exemplary polyamide resins include, but are not limited to, nylon-6; nylon-6,6; nylon-4; nylon-4,6; nylon-12; nylon-6,10; nylon 6,9; nylon-6,12; amorphous polyamide resins; nylon 6/6T, nylon 6,6/6T, nylon 9T, and combinations of two or more of the foregoing polyamides. In one embodiment, the polyamide resin comprises a combination of nylon 6 and nylon 6,6. In one embodiment the polyamide resin or combination of polyamide resins has a melting point (Tm) greater than or equal to 171° C. When the polyamide comprises a super tough polyamide, i.e. a rubber-toughed polyamide, the composition may or may not contain a separate impact modifier.

Polyamide resins can be obtained by a number of well known processes such as those described in U.S. Pat. Nos. 2,071,250; 2,071,251; 2,130,523; 2,130,948; 2,241,322; 2,312,966; and 2,512,606. Polyamide resins are commercially available from a wide variety of sources.

Polyamide resins having an intrinsic viscosity of less than or equal to 400 milliliters per gram (ml/g) can be used, or, more specifically, having a viscosity of 90 to 350 ml/g, or, even more specifically, having a viscosity of 110 to 240 ml/g, as measured in a 0.5 wt % solution in 96 wt % sulfuric acid in accordance with ISO 307.

The polyamide can have a relative viscosity less than or equal to 6, or, more specifically, a relative viscosity of 1.89 to 5.43, or, even more specifically, a relative viscosity of 2.16 to 3.93. Relative viscosity is determined according to DIN 53727 in a 1 wt % solution in 96 wt % sulfuric acid.

In one embodiment, the polyamide resin comprises a polyamide, prior to melt blending with the poly(arylene ether), having an amine end group concentration greater than or equal to 35 microequivalents amine end group per gram of polyamide (μeq/g) as determined by titration with HCl. Within this range, the amine end group concentration can be greater than or equal to 40 μeq/g, or, more specifically, greater than or equal to 45 μeq/g. Amine end group content can be determined by dissolving the polyamide in a suitable solvent, optionally with heat. The polyamide solution is titrated with 0.01 Normal hydrochloric acid (HCl) solution using a suitable indication method. The amount of amine end groups is calculated based the volume of HCl solution added to the sample, the volume of HCl used for the blank, the molarity of the HCl solution and the weight of the polyamide sample.

In one embodiment, the polyamide comprises greater than or equal to 25 weight percent, based on the total weight of the polyamide, of a polyamide having a melt temperature within 20%, or more specifically within 15%, or, even more specifically, within 10% of the glass transition temperature (Tg in ° C.) of the poly(arylene ether) resin used in the composition. As used herein having a melt temperature within 20% of the glass transition temperature of the poly(arylene ether) resin is defined as having a melt temperature that is greater than or equal to (0.8×Tg of the poly(arylene ether) resin) and less than or equal to (1.2×Tg of the poly(arylene ether) resin).

The composition comprises polyamide in an amount of 35 to 85 weight percent wherein the polyamide is the continuous phase in the final composition. Within this range, the polyamide can be present in an amount greater than or equal to 37 weight percent, or, more specifically, in an amount greater than or equal to 39 weight percent. Also within this range, the polyamide can be present in an amount less than or equal to 65 weight percent, or, more specifically, less than or equal to 60 weight percent, or, even more specifically, less than or equal to 55 weight percent. Weight percent is based on the total weight of the thermoplastic composition.

When used herein, the expression "compatibilizing agent" refers to polyfunctional compounds which interact with the poly(arylene ether), the polyamide resin, or both. This interaction can be chemical (e.g., grafting) and/or physical (e.g., affecting the surface characteristics of the dispersed phases). In either instance the resulting compatibilized poly(arylene ether)/polyamide composition appears to exhibit improved compatibility, particularly as evidenced by enhanced impact strength, mold knit line strength and/or elongation. As used herein, the expression "compatibilized poly(arylene ether)/polyamide blend" refers to those compositions which have been physically and/or chemically compatibilized with an agent as discussed above, as well as those compositions which are physically compatible without such agents, as taught in U.S. Pat. No. 3,379,792.

Examples of the various compatibilizing agents that can be employed include: liquid diene polymers, epoxy compounds, oxidized polyolefin wax, quinones, organosilane compounds, polyfunctional compounds, functionalized poly(arylene ether) and combinations comprising at least one of the foregoing. Compatibilizing agents are further described in U.S. Pat. Nos. 5,132,365 and 6,593,411 as well as U.S. Patent Application No. 2003/0166762.

In one embodiment, the compatibilizing agent comprises a polyfunctional compound. Polyfunctional compounds which can be employed as a compatibilizing agent are of three types. The first type of polyfunctional compounds are those having in the molecule both (a) a carbon-carbon double bond or a carbon-carbon triple bond and (b) at least one carboxylic acid, anhydride, amide, ester, imide, amino, epoxy, orthoester, or hydroxy group. Examples of such polyfunctional compounds include maleic acid; maleic anhydride; fumaric acid; glycidyl acrylate, itaconic acid; aconitic acid; maleimide; maleic hydrazide; reaction products resulting from a diamine and maleic anhydride, maleic acid, fumaric acid, etc.; dichloro maleic anhydride; maleic acid amide; unsaturated dicarboxylic acids (e.g., acrylic acid, butenoic acid, methacrylic acid, t-ethylacrylic acid, pentenoic acid); decenoic acids, undecenoic acids, dodecenoic acids, linoleic acid, etc.); esters, acid amides or anhydrides of the foregoing unsaturated carboxylic acids; unsaturated alcohols (e.g. alkyl alcohol, crotyl alcohol, methyl vinyl carbinol, 4-pentene-1-ol, 1,4-hexadiene-3-ol, 3-butene-1,4-diol, 2,5-dimethyl-3-hexene-2,5-diol and alcohols of the formula $C_nH_{2n-5}OH$, $C_nH_{2n-7}OH$ and $C_nH_{2n-9}OH$, wherein n is a positive integer less than or equal to 30); unsaturated amines resulting from replacing from replacing the —OH group(s) of the above unsaturated alcohols with $NH_2$ groups; functionalized diene polymers and copolymers; and combinations comprising one or more of the foregoing. In one embodiment, the compatibilizing agent comprises maleic anhydride and/or fumaric acid.

The second type of polyfunctional compatibilizing agents are characterized as having both (a) a group represented by the formula (OR) wherein R is hydrogen or an alkyl, aryl, acyl or carbonyl dioxy group and (b) at least two groups each of which can be the same or different selected from carboxylic acid, acid halide, anhydride, acid halide anhydride, ester, orthoester, amide, imido, amino, and various salts thereof. Typical of this group of compatibilizers are the aliphatic polycarboxylic acids, acid esters and acid amides represented by the formula:

$$(R^IO)_mR(COOR^{II})_n(CONR^{III}R^{IV})_s$$

wherein R is a linear or branched chain, saturated aliphatic hydrocarbon having 2 to 20, or, more specifically, 2 to 10, carbon atoms; $R^I$ is hydrogen or an alkyl, aryl, acyl, or carbonyl dioxy group having 1 to 10, or, more specifically, 1 to 6, or, even more specifically, 1 to 4 carbon atoms; each $R^{II}$ is independently hydrogen or an alkyl or aryl group having 1 to 20, or, more specifically, 1 to 10 carbon atoms; each $R^{III}$ and $R^{IV}$ are independently hydrogen or an alkyl or aryl group having 1 to 10, or, more specifically, 1 to 6, or, even more specifically, 1 to 4, carbon atoms; m is equal to 1 and (n+s) is greater than or equal to 2, or, more specifically, equal to 2 or 3, and n and s are each greater than or equal to zero and wherein ($OR^I$) is alpha or beta to a carbonyl group and at least two carbonyl groups are separated by 2 to 6 carbon atoms. Obviously, $R^I$, $R^{II}$, $R^{III}$, and $R^{IV}$ cannot be aryl when the respective substituent has less than 6 carbon atoms.

Suitable polycarboxylic acids include, for example, citric acid, malic acid, agaricic acid; including the various commercial forms thereof, such as for example, the anhydrous and hydrated acids; and combinations comprising one or more of the foregoing. In one embodiment, the compatibilizing agent comprises citric acid. Illustrative of esters useful herein include, for example, acetyl citrate, mono- and/or distearyl citrates, and the like. Suitable amides useful herein include, for example, N,N'-diethyl citric acid amide; N-phenyl citric acid amide; N-dodecyl citric acid amide; N,N'-didodecyl citric acid amide; and N-dodecyl malic acid. Derivates include the salts thereof, including the salts with amines and the alkali and alkaline metal salts. Exemplary of suitable salts include calcium malate, calcium citrate, potassium malate, and potassium citrate.

The third type of polyfunctional compatibilizing agents are characterized as having in the molecule both (a) an acid halide group and (b) at least one carboxylic acid, anhydride, ester, epoxy, orthoester, or amide group, preferably a carboxylic acid or anhydride group. Examples of compatibilizers within this group include trimellitic anhydride acid chloride, chloroformyl succinic anhydride, chloro formyl succinic acid, chloroformyl glutaric anhydride, chloroformyl glutaric acid, chloroacetyl succinic anhydride, chloroacetylsuccinic acid, trimellitic acid chloride, and chloroacetyl glutaric acid. In one embodiment, the compatibilizing agent comprises trimellitic anhydride acid chloride.

The foregoing compatibilizing agents can be added directly to the melt blend or pre-reacted with either or both of the poly(arylene ether) and polyamide, as well as with other resinous materials employed in the preparation of the composition. With many of the foregoing compatibilizing agents, particularly the polyfunctional compounds, even greater improvement in compatibility is found when at least a portion of the compatibilizing agent is pre-reacted, either in the melt or in a solution of a suitable solvent, with all or a part of the poly(arylene ether). It is believed that such pre-reacting can cause the compatibilizing agent to react with the polymer and, consequently, functionalize the poly(arylene ether). For example, the poly(arylene ether) can be pre-reacted with maleic anhydride to form an anhydride functionalized polyphenylene ether which has improved compatibility with the polyamide compared to a non-functionalized polyphenylene ether.

Where the compatibilizing agent is employed in the preparation of the compositions, the amount used will be dependent upon the specific compatibilizing agent chosen and the specific polymeric system to which it is added.

Impact modifiers can be block copolymers containing one or more blocks comprising greater than 50 mol % of repeating units resulting from the polymerization of an alkenyl aromatic such as styrene and rubber blocks comprising greater than 50 mol % repeating units resulting from the polymerization of an alkene such as isoprene, butadiene or a combination of isoprene and butadiene. For example A-B diblock copolymers and A-B-A triblock copolymers having of one or two alkenyl aromatic blocks A (blocks having alkenyl aromatic repeating units) which are typically polystyrene blocks, and a rubber block, B, which is typically an isoprene or butadiene block. The butadiene block can be partially or completely hydrogenated. Mixtures of these diblock and triblock copolymers can also be used as well as mixtures of non-hydrogenated copolymers, partially hydrogenated copolymers, fully hydrogenated copolymers and combinations of two or more of the foregoing.

A-B and A-B-A copolymers include, but are not limited to, polystyrene-polybutadiene, polystyrene-poly(ethylene-propylene), polystyrene-polyisoprene, poly(α-methylstyrene)-polybutadiene, polystyrene-polybutadiene-polystyrene (SBS), polystyrene-poly(ethylene-propylene)-polystyrene, polystyrene-polyisoprene-polystyrene and poly(alpha-methylstyrene)-polybutadiene-poly(alpha-methylstyrene), polystyrene-poly(ethylene-propylene-styrene)-polystyrene, and the like. Mixtures of the aforementioned block copolymers are also useful. Such A-B and A-B-A block copolymers are available commercially from a number of sources, including Phillips Petroleum under the trademark SOLPRENE, Kraton Polymers, under the trademark KRATON, Dexco under the trademark VECTOR, Asahi Kasai under the trademark TUFTEC, Total Petrochemicals under the trademarks FINAPRENE and FINACLEAR and Kuraray under the trademark SEPTON.

In one embodiment, the impact modifier comprises polystyrene-poly(ethylene-butylene)-polystyrene, polystyrene-poly(ethylene-propylene) or a combination of the foregoing.

Another type of impact modifier is essentially free of alkenyl aromatic repeating units and comprises one or more moieties selected from the group consisting of carboxylic acid, anhydride, epoxy, oxazoline, and orthoester. Essentially free is defined as having alkenyl aromatic units present in an amount less than 5 weight percent, or, more specifically, less than 3 weight percent, or, even more specifically less than 2 weight percent, based on the total weight of the block copolymer. When the impact modifier comprises a carboxylic acid moiety the carboxylic acid moiety can be neutralized with an ion, preferably a metal ion such as zinc or sodium. The impact modifier can be an alkylene-alkyl (meth)acrylate copolymer and the alkylene groups can have 2 to 6 carbon atoms and the alkyl group of the alkyl (meth)acrylate can have 1 to 8 carbon atoms. This type of polymer can be prepared by copolymerizing an olefin, for example, ethylene and propylene, with various (meth)acrylate monomers and/or various maleic-based monomers. The term (meth)acrylate refers to both the acrylate as well as the corresponding methacrylate analogue. Included within the term (meth)acrylate monomers are alkyl (meth)acrylate monomers as well as various (meth)acrylate monomers containing at least one of the aforementioned reactive moieties.

In a one embodiment, the copolymer is derived from ethylene, propylene, or mixtures of ethylene and propylene, as the alkylene component; butyl acrylate, hexyl acrylate, or propyl acrylate as well as the corresponding alkyl (methyl) acrylates, for the alkyl (meth)acrylate monomer component, with acrylic acid, maleic anhydride, glycidyl methacrylate or a combination thereof as monomers providing the additional reactive moieties (i.e., carboxylic acid, anhydride, epoxy).

Exemplary impact modifiers essentially free of alkenyl aromatic repeating units are commercially available from a variety of sources including ELVALOY PTW, SURLYN, and FUSABOND, all of which are available from DuPont.

The aforementioned impact modifiers can be used singly or in combination.

The composition can comprise an impact modifier or a combination of impact modifiers, in an amount of 1 to 15 weight percent. Within this range, the impact modifier can be present in an amount greater than or equal to 1.5 weight percent, or, more specifically, in an amount greater than or equal to 2 weight percent, or, even more specifically, in an amount greater than or equal to 3 weight percent. Also within this range, the impact modifier can be present in an amount less than or equal to 13 weight percent, or, more specifically, less than or equal to 12 weight percent, or, even more specifically, less than or equal to 10 weight percent. Weight percent is based on the total weight of the thermoplastic composition.

The electrically conductive additive can comprise electrically conductive carbon black, carbon nanotubes, carbon fibers or a combination of two or more of the foregoing. Electrically conductive carbon blacks are commercially available and are sold under a variety of trade names, including but not limited to S.C.F. (Super Conductive Furnace), E.C.F. (Electric Conductive Furnace), Ketjen Black EC (available from Akzo Co., Ltd.) or acetylene black. In some embodiments the electrically conductive carbon black has an average particle size less than or equal to 200 nanometers (nm), or, more specifically, less than or equal to 100 nm, or, even more specifically, less than or equal to 50 nm. The electrically conductive carbon blacks can also have surface areas greater than 200 square meter per gram ($m^2/g$), or, more specifically, greater than 400 $m^2/g$, or, even more specifically, greater than 1000 $m^2/g$. The electrically conductive carbon black can have a pore volume greater than or equal to 40 cubic centimeters per hundred grams ($cm^3/100$ g), or, more specifically, greater than or equal to 100 $cm^3/100$ g, or, even more specifically, greater than or equal to 150 $cm^3/100$ g, as determined by dibutyl phthalate absorption.

Carbon nanotubes that can be used include single wall carbon nanotubes (SWNTs), multiwall carbon nanotubes (MWNTs), vapor grown carbon fibers (VGCF) and combinations comprising two or more of the foregoing.

Single wall carbon nanotubes (SWNTs) can be produced by laser-evaporation of graphite, carbon arc synthesis or a high-pressure carbon monoxide conversion process (HIPCO) process. These SWNTs generally have a single wall comprising a graphene sheet with outer diameters of 0.7 to 2.4 nanometers (nm). The SWNTs can comprise a mixture of metallic SWNTs and semi-conducting SWNTs. Metallic SWNTs are those that display electrical characteristics similar to metals, while the semi-conducting SWNTs are those that are electrically semi-conducting. In some embodiments it is desirable to have the composition comprise as large a fraction of metallic SWNTs as possible. SWNTs can have aspect ratios of greater than or equal to 5, or, more specifically, greater than or equal to 100, or, even more specifically, greater than or equal to 1000. While the SWNTs are generally closed structures having hemispherical caps at each end of the respective tubes, it is envisioned that SWNTs having a single open end or both open ends can also be used. The SWNTs generally comprise a central portion, which is hollow, but can be filled with amorphous carbon.

In one embodiment the SWNTs comprise metallic nanotubes in an amount of greater than or equal to 1 wt %, or, more specifically, greater than or equal to 20 wt %, or, more specifically, greater than or equal to 30 wt %, or, even more specifically greater than or equal to 50 wt %, or, even more specifically, greater than or equal to 99.9 wt % of the total weight of the SWNTs.

In one embodiment the SWNTs comprise semi-conducting nanotubes in an amount of greater than or equal to 1 wt %, or, more specifically, greater than or equal to 20 wt %, or, more specifically, greater than or equal to 30 wt %, or, even more specifically, greater than or equal to 50 wt %, or, even more specifically, greater than or equal to 99.9 wt % of the total weight of the SWNTs.

MWNTs can be produced by processes such as laser ablation and carbon arc synthesis. MWNTs have at least two graphene layers bound around an inner hollow core. Hemispherical caps generally close both ends of the MWNTs, but it is also possible to use MWNTs having only one hemispherical cap or MWNTs which are devoid of both caps. MWNTs generally have diameters of 2 to 50 nm. Within this range, the MWNTs can have an average diameter less than or equal to 40, or, more specifically, less than or equal to 30, or, even more specifically less than or equal to 20 nm. MWNTs can have an average aspect ratio greater than or equal to 5, or, more specifically, greater than or equal to 100, or, even more specifically greater than or equal to 1000.

Vapor grown carbon fibers (VGCF) are generally manufactured in a chemical vapor deposition process. VGCF having "tree-ring" or "fishbone" structures can be grown from hydrocarbons in the vapor phase, in the presence of particulate metal catalysts at moderate temperatures, such as 800 to 1500° C. In the "tree-ring" structure a multiplicity of substantially graphitic sheets are coaxially arranged about the core. In the "fishbone" structure, the fibers are characterized by graphite layers extending from the axis of the hollow core.

VGCF having diameters of 3.5 to 2000 nanometers (nm) and aspect ratios greater than or equal to 5 can be used. VGCF can have diameters of 3.5 to 500 nm, or, more specifically 3.5 to 100 nm, or, even more specifically 3.5 to 50 nm. VGCF can have an average aspect ratios greater than or equal to 100, or, more specifically, greater than or equal to 1000.

Various types of conductive carbon fibers can also be used in the composition. Carbon fibers are generally classified according to their diameter, morphology, and degree of graphitization (morphology and degree of graphitization being interrelated). These characteristics are presently determined by the method used to synthesize the carbon fiber. For example, carbon fibers having diameters down to 5 micrometers, and graphene ribbons parallel to the fiber axis (in radial, planar, or circumferential arrangements) are produced commercially by pyrolysis of organic precursors in fibrous form, including phenolics, polyacrylonitrile (PAN), or pitch.

The carbon fibers generally have a diameter of greater than or equal to 1,000 nanometers (1 micrometer) to 30 micrometers. Within this range fibers having sizes of greater than or equal to 2, or, more specifically, greater than or equal to 3, or, more specifically greater than or equal to 4 micrometers can be used. Also within this range fibers having diameters of less than or equal to 25, or, more specifically, less than or equal to 15, or, even more specifically less than or equal to 11 micrometers can be used.

The composition comprises a sufficient amount of electrically conductive additive to achieve a specific volume resistivity less than or equal to $10^6$ ohm-cm. For example, the composition can comprise electrically conductive carbon black, carbon fibers, carbon nanotubes or a combination of two or more of the foregoing electrically conductive additives in an amount of 1 to 20 weight percent. Within this range, the electrically conductive additive can be present in an amount greater than or equal to 1.2 weight percent, or, more specifically, in an amount greater than or equal to 1.3 weight percent, or, even more specifically, in an amount greater than or equal to 1.4 weight percent. Also within this range, the electrically conductive carbon additive can be present in an amount less than or equal to 15 weight percent, or, more specifically, less than or equal to 10 weight percent, or, even more specifically, less than or equal to 5 weight percent. Weight percent is based on the total weight of the thermoplastic composition.

In some embodiments it is desirable to incorporate a sufficient amount of electrically conductive additive to achieve a specific volume resistivity that is sufficient to permit the composition to dissipate electrostatic charges or to be thermally dissipative.

The composition can be prepared by melt mixing or a combination of dry blending and melt mixing (melt compounding). Melt mixing can be performed in single or twin screw type extruders or similar mixing devices which can apply a shear to the components.

All of the ingredients can be added initially to the processing system. In some embodiments, the poly(arylene ether) can be pre-melt mixed with the compatibilizing agent. Additionally other ingredients such as an impact modifier, additives, and a portion of the polyamide can be pre-melt mixed with the compatibilizing agent and poly(arylene ether). In one embodiment, the poly(arylene ether) is pre-melt mixed with the compatibilizing agent to form a functionalized poly (arylene ether). The functionalized poly(arylene ether) is then melt mixed with the other ingredients. In another embodiment the poly(arylene ether), compatibilizing agent, impact modifier, optional additives are melt mixed to form a first material and the polyamide is then melt mixed with the first material.

When using an extruder, all or part of the polyamide can be fed through a port downstream. While separate extruders can be used in the processing, preparations in a single extruder having multiple feed ports along its length to accommodate the addition of the various components simplifies the process. It is often advantageous to apply a vacuum to the melt through one or more vent ports in the extruder to remove volatile impurities in the composition. In high viscosity compositions such as those described herein, additional processing steps lead to extra time under extreme shearing and shear heating conditions, which can lead to material degradation and can contribute to or cause die-lip build-up during the final forming processes. Therefore it is not desirable to perform any additional melt mixing steps after all of the polyamide has been melt mixed into the composition.

The electrically conductive additive can be added by itself, with other ingredients (optionally as a dry blend) or as part of a masterbatch. In one embodiment, the electrically conductive additive can be part of a masterbatch comprising polyamide. The electrically conductive additive (independently or as a masterbatch) can be added with the poly(arylene ether) or with the polyamide (the second portion when two portions are employed). In one embodiment the electrically conductive additive is added as part of a masterbatch in polyamide after the addition of all other components of the composition.

In one embodiment the composition comprises the reaction product of poly(arylene ether); polyamide; electrically conductive additive; compatibilizing agent; and impact modifier. As used herein a reaction product is defined as the product resulting from the reaction of two or more of the foregoing components under the conditions employed to form the composition, for example during melt mixing.

After the composition is formed it is typically formed into strands which are cut to form pellets. The strand diameter and the pellet length are typically chosen to prevent or reduce the production of fines (particles that have a volume less than or equal to 50% of the pellet) and for maximum efficiency in subsequent processing such as profile extrusion. An exemplary pellet length is 1 to 5 millimeters and an exemplary pellet diameter is 1 to 5 millimeters.

The pellets can exhibit hygroscopic properties. Once water is absorbed it can be difficult to remove. Typically drying is employed but extended drying can affect the performance of the composition. Similarly water, outside the range of 0.01-0.1%, or, more specifically, 0.02-0.07% moisture by weight, can hinder the use of the composition in some applications. It is advantageous to protect the composition from ambient moisture. In one embodiment the pellets, once cooled to a temperature of 50° C. to 110° C., are packaged in a container comprising a moisture barrier layer, e.g., a mono-layer of polypropylene resin free of a metal layer wherein the container has a wall thickness of 0.25 millimeters to 0.60 millimeters. The pellets, once cooled to 50 to 110° C. can also be packaged in foiled lined containers such as foil lined boxes and foil lined bags.

The composition can be converted to articles using forming processes such as film and sheet extrusion, profile extrusion, extrusion molding, compression molding, vacuum forming, and blow molding. Film and sheet extrusion processes can include and are not limited to melt casting, blown film extrusion and calendaring. Co-extrusion and lamination processes can be employed to form composite multi-layer films or sheets. Single or multiple layers of coatings can further be applied to the single or multi-layer substrates to impart additional properties such as scratch resistance, ultra violet light resistance, aesthetic appeal, etc. Coatings can be applied through standard application techniques such as rolling, spraying, dipping, brushing, or flow-coating.

Oriented films can be prepared through blown film extrusion or by stretching cast or calendared films in the vicinity of the thermal deformation temperature using conventional stretching techniques. For instance, a radial stretching pantograph can be employed for multi-axial simultaneous stretching; an x-y direction stretching pantograph can be used to simultaneously or sequentially stretch in the planar x-y directions. Equipment with sequential uniaxial stretching sections can also be used to achieve uniaxial and biaxial stretching, such as a machine equipped with a section of differential speed rolls for stretching in the machine direction and a tenter frame section for stretching in the transverse direction.

The compositions can be converted to multiwall sheet comprising a first sheet having a first side and a second side, wherein the first sheet comprises a thermoplastic polymer, and wherein the first side of the first sheet is disposed upon a first side of a plurality of ribs; and a second sheet having a first side and a second side, wherein the second sheet comprises a thermoplastic polymer, wherein the first side of the second sheet is disposed upon a second side of the plurality of ribs, and wherein the first side of the plurality of ribs is opposed to the second side of the plurality of ribs.

The films and sheets described above can further be thermoplastically processed into shaped articles via forming and molding processes including but not limited to thermoforming, vacuum forming, pressure forming and compression molding. Multi-layered shaped articles can also be formed by injection molding a thermoplastic resin onto a single or multi-layer film or sheet substrate as described below:

1. Providing a single or multi-layer thermoplastic substrate having optionally one or more colors on the surface, for instance, using screen printing or a transfer dye
2. Conforming the substrate to a mold configuration such as by forming and trimming a substrate into a three dimensional shape and fitting the substrate into a mold having a surface which matches the three dimensional shape of the substrate.
3. Injecting a thermoplastic resin into the mold cavity behind the substrate to (i) produce a one-piece permanently bonded three-dimensional product or (ii) transfer a pattern or aesthetic effect from a printed substrate to the injected resin and remove the printed substrate, thus imparting the aesthetic effect to the formed resin.

Those skilled in the art will also appreciate that common curing and surface modification processes including and not limited to heat-setting, texturing, embossing, corona treatment, flame treatment, plasma treatment and vacuum deposition can further be applied to the above articles to alter surface appearances and impart additional functionalities to the articles.

Accordingly, another embodiment relates to articles, sheets and films prepared from the compositions above.

Exemplary articles include all or portions of the following articles: furniture, partitions, containers, vehicle interiors including rail cars, subway cars, busses, trolley cars, airplanes, automobiles, and recreational vehicles, exterior vehicle accessories such as roof rails, appliances, cookware, electronics, analytical equipment, window frames, wire conduit, flooring, infant furniture and equipment, telecommunications equipment, antistatic packaging for electronics equipment and parts, health care articles such as hospital beds and dentist chairs, exercise equipment, motor covers, display covers, business equipment parts and covers, light covers, signage, air handling equipment and covers, automotive underhood parts.

The following non-limiting examples further illustrate the various embodiments described herein.

EXAMPLES

The following examples used the materials listed in Table 1.

TABLE 1

| Component | Supplier/Description |
|---|---|
| PPE-1 | A poly(2,6 dimethylphenylene ether) having an intrinsic viscosity of 0.46 dl/g as determined in chloroform at 25° C. and a glass transition temperature of 213° C. which is available from GE Advanced Materials as PPO646. |
| PPE-2 | A poly(2,6 dimethylphenylene ether) having an intrinsic viscosity of 0.40 dl/g as determined in chloroform at 25° C. and a glass transition temperature of 213° C. which is available from GE Advanced Materials as PPO640. |
| PA6 | A polyamide having a melting temperature of 220° C. and a relative viscosity of 2.4 measured via DIN53727. The polyamide is commercially available from Rhodia under the tradename Technyl HSN 27. |
| PA66-1 | A polyamide having a melting temperature of 260° C. and a relative viscosity of 2.7 as measured by DIN53727. The polyamide is commercially available from Solutia under the tradename Vydyne 21Z. |
| PA66-2 | A polyamide having a melting temperature of 260° C. and a relative viscosity of 2.55 as measured by DIN53727. The polyamide is commercially available from Rhodia under the tradename Technyl 24FE1. |
| SEBS | A polystyrene-poly(ethylene-butylene)-polystyrene block copolymer commercially available from Kraton Polymers under the tradename Kraton G1651. |
| SEP | A polystyrene-poly(ethylene-propylene) block copolymer commercially available from Kraton Polymers under the tradename Kraton G1701. |
| CCB | An electrically conductive carbon black commercially available from Akzo Nobel under the tradename Ketjen Black EC600JD. |

Examples 1-8

Example 1 has the composition as shown in Table 2. Example 1 was prepared by melt mixing the PPE, SEBS, citric acid (0.6 weight %) and stabilizers (0.45 weight %) to form a first mixture, then adding the polyamides to the first mixture to form a second mixture and then adding the CCB to the second mixture. The example was melt mixed on a co-rotating intermeshing twin screw extruder at a screw speed of 450 rpm and with a melt temperature of 340° C.

Examples 2-6 have the compositions as shown in Table 2. Examples 2-6 were prepared by melt mixing the PPE, SEBS, citric acid (0.6 weight %) and stabilizers (0.45 weight %) to form a first mixture, then adding the polyamides and the CCB to the first mixture to form a second mixture. In examples 2, 3, and 4, the CCB was added in a 10% by weight masterbatch in the polyamide 6 (the masterbatch comprised 10% by weight of CCB based on the total weight of the masterbatch). In Examples 5 and 6, the CCB masterbatch was added in an 8% by weight masterbatch in the polyamide 66-1. Examples 2-6 were prepared on a twin screw co-rotating intermeshing extruder with a screw speed of 280 rpm and a melt temperature of 310° C.

Example 7 has the composition as shown in Table 2. Example 7 was prepared by melt mixing the PPE, SEBS, citric acid (0.6 weight %), stabilizers (0.45 weight %) and 16.3 weight %, based on the total weight of the composition, of PA6 to form a first mixture, then adding the remainder of PA6 and all of the PA66 and the conductive carbon black to the first mixture to form a second mixture. In this example, the CCB was added in a 10% by weight masterbatch in the PA6. Example 7 was prepared on a twin screw co-rotating intermeshing extruder with a screw speed of 280 rpm and a melt temperature of 310° C.

Example 8 has the composition as shown in Table 2. Example 8 was prepared similarly to Example 1: by melt mixing the PPE, SEBS, SEP, citric acid (0.7 weight %), and stabilizers (0.71 weight %) to form a first mixture, then adding the polyamides to the first melt mixture to form a second mixture and then adding the CCB to the second mixture. Example 8 was prepared on a co-rotating, intermeshing, twin screw extruder set at 600 rpm and 310° C.

Example 9 has the composition as shown in Table 2. Example 9 was prepared by melt mixing the PPE, SEBS, citric acid (0.6 weight %), stabilizers (0.45 weight %), and 14.3 weight %, based on the total weight of the composition, of PA6 to form a first mixture, then adding the remainder of PA6, the PA66-1 and the carbon black to the first mixture to form a second mixture. The CCB was added as a 10% by weight masterbatch in the PA6. In this example the composition was prepared on a co-rotating, intermeshing, twin-screw extruder operating at 280 rpm and set temperatures between 290 and 315° C.

Example 10 contains 75 weight percent of pellets made according to Example 1 and 25 weight percent of pellets made according to Example 9. Example 11 contains 50 weight percent of pellets made according to Example 1 and 50 weight percent of pellets made according to Example 9. Example 12 contains 25 weight percent of pellets made according to Example 1 and 75 weight percent of pellets made according to Example 9.

Figure 1:
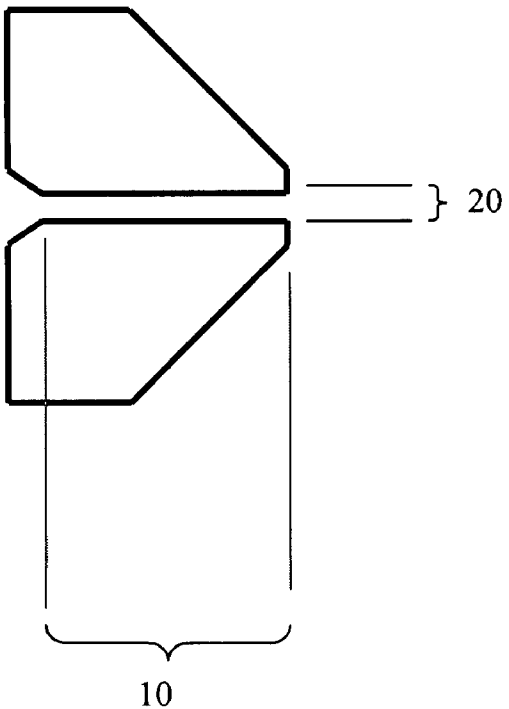
FIG. 1 is a cross sectional view of a rectangular slit die.
Figure 3:
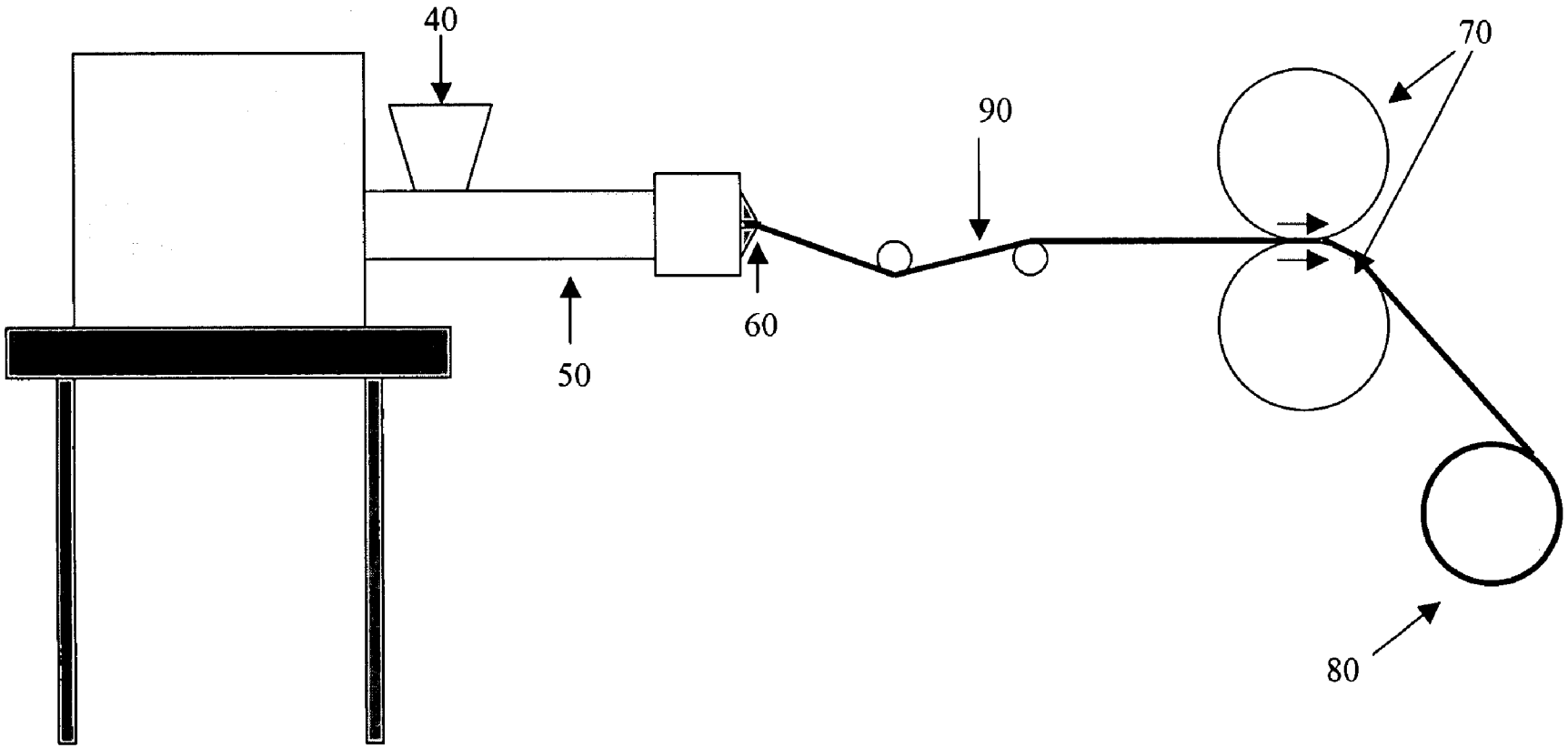
FIG. 3 is a schematic representation of ribbon extrusion.

After melt compounding to make the compositions, the compositions were extruded to form ribbons. Extrusion of the ribbons was performed using a laboratory scale bench top single screw extruder such as a Brabender Prep-center with a 19 millimeter diameter single screw extruder attachment. FIG. 3 is a schematic view of the ribbon extrusion. Pellets are fed into the hopper, 40, and melted in the barrel, 50, which contains the screw. The molten composition is forced out through the die, 60, to form a ribbon, 90. The ribbon is drawn out by the pullin reels, 70, and collected on the uptake reel, 80. The screw was a single stage screw that had a length to diameter ratio of 25/1 and a compression ratio of 3:1. The machine was set at 100 rotations per minute (rpm) and a temperature profile starting at the throat of 250° C., 260° C., 260° C., and a die temperature of 280° C. A variable thickness ribbon die was used that had a width of 102 millimeters and was set at 2.0 millimeters in thickness for a perimeter of 0.208 meters. The die had a depth of 29 millimeters. FIG. 1 is a cross sectional view of the rectangular slit die showing the depth, 10, and the opening height, 20. FIG. 2 is a front view of the rectangular slit die showing the length, 30, and the opening height, 20.

All materials were dried to below 0.05% by weight moisture before running. The material flow through the die was between 4.5 kg/hr and 5.5 kg/hr as determined by measuring the weight of the ribbon extruded over a given time span. The downstream equipment was set such that the ribbon was being pulled at a rate of 1.45-1.50 meters/minute. The procedure was as follows: 1) The sample material was run through the equipment for 15 minutes in order to reach steady state. 2) At the 15 minute mark, the die was scraped clean. 3) The material was allowed to run for an additional 5 minutes. 4) After the 5 minutes, the die lip build-up from the upper and lower surface of the die was scraped onto the ribbon. 5) After the sample cooled, the build-up was scraped off the ribbon and the build up was weighed using an analytical balance at 23° C. Ribbon appearance was visually evaluated on a scale of 1-10 with lower numbers representing significant amounts of die lip buildup. Ratings of 9 or 10 are passing and a rating of 8 is a borderline evaluation. A rating of 8 was found to correlate to 0.0150 grams of die build-up per minute of extrusion per meter of die opening perimeter.

Melt Volume Rate testing was performed in accordance with ISO 1133. The temperature used was 300° C. and a load of 5 kg was applied. The pellets of the compositions were all dried prior testing to ensure moisture content lower than 0.05 weight %. One potential means to achieve this was to dry the pellets of the compositions at 120° C. in a vacuum oven under an applied vacuum of 20 inches of Hg for 5 hours. Vicat testing was performed on ISO standard 80 mm by 40 mm by 10 mm parts molded as described in the description of the Specific Volume Resistivity below. Vicat testing was done under conditions of 120 degrees per hour heating and a force of 50 Newtons according to ISO 306.

Data is shown in Tables 3 and 4. Compositional amounts in Table 2 are in weight percent based on the total weight of the composition.

Some examples were tested for specific volume resistivity (SVR). The compositions were molded into ISO tensile bars using a barrel set temperature of 288° C. and a mold set temperature of 88° C. The bars were scored with a knife at both ends of the neck, approximately 6.35 centimeters (cm) apart. The scored parts were submerged into liquid nitrogen for approximately 5 minutes. As soon as the bars were removed from the liquid nitrogen they were snapped at the score marks. The bars were left to sit at 23° C. and 50% relative humidity for 1 hour after which the broken faces of the parts were painted with electrically conductive silver paint and allowed to dry for 2 hours. Resistance was measured by placing the probes of a handheld multimeter, such as a Fluke 187 True-rms multmeter, on each painted end of the bar. All sample preparation and testing was performed in a laboratory at 23° C. and 50% relative humidity. The resistivity was calculated as the resistance (in Ohms)×bar width (in centimeters (cm))×bar depth (cm) divided by the bar length (cm).

TABLE 2

| | 1* | 2 | 3 | 4 | 5 | 6* | 7 | 8* | 9 |
|---|---|---|---|---|---|---|---|---|---|
| PPE-1 | 49.05 | 49.05 | 49.05 | 49.05 | 49.05 | 49.05 | 49.05 | | 48.95 |
| PPE-2 | — | — | — | — | — | — | — | 34 | — |
| PA6 | 32.5 | 43.8 | 32.5 | 21.9 | 11.3 | — | 32.5 | 10 | 32.3 |
| PA66-1 | 11.3 | — | 11.3 | 21.9 | 32.5 | 43.8 | 11.3 | — | 11.3 |
| PA66-2 | — | — | — | — | — | — | — | 37.9 | — |
| SEBS | 4.2 | 4.2 | 4.2 | 4.2 | 4.2 | 4.2 | 4.2 | 7 | 4.2 |
| SEP | — | — | — | — | — | — | — | 8 | — |
| CCB | 1.8 | 1.8 | 1.8 | 1.8 | 1.8 | 1.8 | 1.8 | 1.7 | 2 |

*Comparative Example

TABLE 3

| | 1* | 2 | 3 | 4 | 5 | 6* | 7 | 8* |
|---|---|---|---|---|---|---|---|---|
| VicatB120 (° C.) | 197.4 | 197 | 197.2 | 201.8 | 204.2 | 210.6 | 198.1 | 204.9 |
| SVR (Ohm-cm) | $1.2 \times 10^3$ | $2.8 \times 10^3$ | $3.5 \times 10^3$ | $2.3 \times 10^3$ | $1.0 \times 10^6$ | $5.7 \times 10^3$ | $2.0 \times 10^3$ | $8.7 \times 10^3$ |
| MVR (cc/10 min) | 13.2 | 7.6 | 5.8 | 9.4 | 12.8 | 20.8 | 9.99 | 32.2 |
| Build Up (g/m*min) | 0.26443 | 0.00035 | 0.00020 | 0.00096 | 0.00048 | 0.00028 | 0.00048 | 0.00144 |
| Rating | 1 | 9 to 10 | 9 to 10 | 9 to 10 | 9 to 10 | 9 to 10 | 9 to 10 | 9 |

*Comparative example

TABLE 4

| | 1* | 9 | 10 | 11 | 12 |
|---|---|---|---|---|---|
| Vicat B120 (° C.) | 197.4 | 199 | — | — | — |
| SVR (Ohm-cm) | $1.2 \times 10^3$ | $3.4 \times 10^3$ | — | — | — |
| MVR (cc/10 min) | 13.2 | 5.6 | — | — | — |
| Build Up (g/(m*min) | 0.26443 | 0.00048 | .06567 | .01029 | .00240 |
| Rating | 1 | 9 to 10 | 4 | 8 to 9 | 9 |

As can be seen from the foregoing examples, Examples 2 through 5 and Example 7 in Table 3 demonstrate the desired combination of heat resistance, resistivity, MVR and low die-lip build-up. Example 1 has the desired attributes except that it has unacceptably high die-lip build-up. The large amount of die-lip build-up makes the blend undesirable for commercial forming processes due to lower productivity from die cleaning and potentially the build-up breaking away from the die and sticking in the downstream shaping blocks. Examples 6 and 8 both demonstrate all of the desired attributes except that they have very high melt volume rates. This makes these compositions less attractive for forming techniques requiring high melt strength.

In Table 4 it can be seen that again Example 1 has the deficiency of a high amount of die-lip build-up. Example 9 on the other hand, while being very similar in component types and loadings to Example 1 has very low die-lip build-up. This is attributed to the difference in the process used to create the two compositions. In Example 1, there is an extra melt mixing step in the process where the conductive carbon black is added to rest of the components, which have already been melt mixed. In Example 9, the CCB is melt mixed along with the last portion of the polyamide. Therefore only two melt mixing steps take place. The removal of the final melt mixing step from the process of Example 1 results in a composition with lower die-lip build-up. In fact, it takes at least 50% of the composition of Example 9 by weight mixed into the composition of Example 1 in order to get to what is considered a borderline acceptable amount of die-lip build-up.

While the invention has been described with reference to an exemplary embodiment, it will be understood by those skilled in the art that various changes can be made and equivalents can be substituted for elements thereof without departing from the scope of the invention. In addition, many modifications can be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A composition comprising a poly(arylene ether)

a polyamide;

an electrically conductive additive; and a polymeric impact modifier, wherein the polyamide comprises greater than or equal to 25 weight percent, based on the total weight of the polyamide, of a polyamide having a melt temperature within 20% of the glass transition temperature of the poly(arylene ether);

wherein the composition has a melt volume rate less than or equal to 15 cubic centimeters per 10 minutes as determined by ISO 1133 performed at 300° C. with a load of 5 kilograms when the composition moisture content, at the time of testing, is less than or equal to 0.05 weight percent (wt %), based on the total weight of the composition, and further wherein the composition demonstrates less than or equal to 0.0150 grams of composition buildup on the die face per minute of running time per meter of die opening perimeter after extruding the composition at a steady state for five minutes at 260° C. and 100 rotations per minute (rpm) on a 19 millimeter diameter single screw extruder through a rectangular slit die having a width of 102 millimeters (mm), an opening height of 2 mm and a depth of 29 mm with a die set temperature of 280° C. and further wherein no cooling means is applied to the extruded composition until the composition is greater than or equal to 100 millimeters from the die face and the composition has a flow rate through the die of 4.5 to 5.5 kilograms per hour as determined by weighing the extruded composition that has gone through downstream uptake reels over a known amount of time.

2. The composition of claim 1, wherein the amount of composition buildup on the die face is less than or equal to 0.0118 grams.

3. The composition of claim 1, wherein the composition has a melt volume rate less than or equal to 13 cubic centimeters per 10 minutes.

4. The composition of claim 1, wherein the composition has a Vicat B120 greater than or equal to 170° C. when Vicat B120 is determined using ISO 306 standards.

5. The composition of claim 1, wherein the composition has a specific volume resistivity less than or equal to $10^6$ ohm-cm.

6. The composition of claim 1, wherein the poly(arylene ether) has a glass transition temperature, as determined by differential scanning calorimetry at 20° C./minute ramp, of 160° C. to 250° C.

7. The composition of claim 1, wherein the composition comprises poly(arylene ether) in an amount of 15 to 65 weight percent, polyamide in an amount of 35 to 85 weight percent, and an impact modifier or a combination of impact modifiers, in an amount of 1 to 15 weight percent, wherein the amounts are based on the total weight of the thermoplastic composition.

8. The composition of claim 1, wherein the polyamide comprises a polyamide having an amine end group concentration greater than or equal to about 35 microequivalents amine end group per gram of polyamide (μeq/g) as determined by titration with HCl.

9. The composition of claim 1 wherein the impact modifier comprises polystyrene-poly(ethylene-butene)-polystyrene, polystyrene-poly(ethylene-propylene) or a combination of the foregoing.

10. The composition of claim 1 wherein the electrically conductive additive comprises carbon black, carbon nanotubes, carbon fibers or a combination of two or more electrically conductive additives.

11. The composition of claim 1 wherein the composition comprises a compatibilized poly(arylene ether)/polyamide blend.

12. A composition comprising
a poly(arylene ether)
a polyamide;
an electrically conductive additive; and
a polymeric impact modifier,
wherein the polyamide comprises greater than or equal to 25 weight percent, based on the total weight of the polyamide, of a polyamide having a melt temperature within 20% of the glass transition temperature of the poly(arylene ether), and
further wherein the composition demonstrates less than or equal to 0.0150 grams of composition buildup on the die face per minute of running time per meter of die opening perimeter after extruding the composition at a steady state for five minutes at 260° C. and 100 rotations per minute (rpm) on a 19 millimeter diameter single screw extruder through a rectangular slit die having a width of 102 millimeters (mm), an opening height of 2 mm and a depth of 29 mm with a die set temperature of 280° C. and further wherein no cooling means is applied to the extruded composition until the composition is greater than or equal to 100 millimeters from the die face and the composition has a flow rate through the die of 4.5 to 5.5 kilograms per hour as determined by weighing the extruded composition that has gone through downstream uptake reels over a known amount of time.

13. The composition of claim 12, wherein the amount of composition buildup on the die face is less than or equal to 0.118 grams.

14. The composition of claim 12, wherein the composition has a melt volume rate less than or equal to 13 cubic centimeters per 10 minutes.

15. The composition of claim 12, wherein the composition has a Vicat B120 greater than or equal to 170° C. when Vicat B120 is determined using ISO 306 standards.

16. The composition of claim 12, wherein the composition has a specific volume resistivity less than or equal to $10^6$ ohm-cm.

17. The composition of claim 12, wherein the poly(arylene ether) has a glass transition temperature, as determined by differential scanning calorimetry at 20° C./minute ramp, of 160° C. to 250° C.

18. The composition of claim 12, wherein the composition comprises poly(arylene ether) in an amount of 15 to 65 weight percent, polyamide in an amount of 35 to 85 weight percent, and an impact modifier or a combination of impact modifiers, in an amount of 1 to 15 weight percent, wherein the amounts are based on the total weight of the thermoplastic composition.

19. The composition of claim 12, wherein the polyamide comprises a polyamide having an amine end group concentration greater than or equal to about 35 microequivalents amine end group per gram of polyamide (μeq/g) as determined by titration with HCl.

20. The composition of claim 12 wherein the impact modifier comprises polystyrene-poly(ethylene-butene)-polystyrene, polystyrene-poly(ethylene-propylene) or a combination of the foregoing.

21. The composition of claim 12, wherein the electrically conductive additive comprises carbon black, carbon nanotubes, carbon fibers or a combination of two or more electrically conductive additives.

22. The composition of claim 12 wherein the composition comprises a compatibilized poly(arylene ether)/polyamide blend.

23. A composition produced by melt mixing a mixture of
a poly(arylene ether);
a polyamide;
an electrically conductive additive;
a compatibilizing agent; and
a polymeric impact modifier,
wherein the polyamide comprises greater than or equal to 25 weight percent, based on the total weight of the polyamide, of a polyamide having a melt temperature within 20% of the glass transition temperature of the poly(arylene ether),
wherein the electrically conductive additive is added to the mixture prior to a last addition of polyamide or with a last addition of polyamide and
further wherein the composition demonstrates less than or equal to 0.0150 grams of composition buildup on the die face per minute of running time per meter of die opening perimeter after extruding the composition at a steady state for five minutes at 260° C. and 100 rotations per minute on a 19 millimeter diameter single screw extruder through a rectangular slit die having a width of 102 millimeters, an opening height of 2 millimeters and a depth of 29 millimeters with a die set temperature of 280° C. and further wherein no cooling means is applied to the extruded composition until the composition is greater than or equal to 100 millimeters from the die face and the composition has a flow rate through the die of 4.5 to 5.5 kilograms per hour as determined by weighing the extruded composition that has gone through downstream uptake reels over a known amount of time.

24. The composition of claim 23 wherein the compatibilizing agent comprises citric acid, maleic anhydride, and/or fumaric acid.

25. A composition comprising the reaction product of
a poly(arylene ether);
a polyamide;
an electrically conductive additive;
a compatibilizing agent; and
a polymeric impact modifier,
wherein the composition has a melt volume rate less than or equal to 15 cubic centimeters per 10 minutes as determined by ISO 1133 performed at 3000° C. with a load of 5 kilograms when the composition moisture content, at the time of testing, is less than or equal to 0.05 weight percent (wt %), based on the total weight of the composition, and
further wherein the polyamide comprises greater than or equal to 25 weight percent, based on the total weight of the polyamide, of a polyamide having a melt temperature within 20% of the glass transition temperature of the poly(arylene ether), and
further wherein the composition demonstrates less than or equal to 0.0150 grams of composition buildup on the die face per minute of running time per meter of die opening perimeter after extruding the composition at a steady state for five minutes at 260° C. and 100 rotations per minute (rpm) on a 19 millimeter diameter single screw extruder through a rectangular slit die having a width of 102 millimeters (mm), an opening height of 2 mm and a depth of 29 mm with a die set temperature of 2800° C. and further wherein no cooling means is applied to the extruded composition until the composition is greater than or equal to 100 millimeters from the die face and the composition has a flow rate through the die of 4.5 to 5.5 kilograms per hour as determined by weighing the extruded composition that has gone through downstream uptake reels over a known amount of time.

* * * * *